US005687886A

United States Patent [19]

Bolton

[11] Patent Number: 5,687,886

[45] Date of Patent: Nov. 18, 1997

[54] HAND-HELD LIQUID DISPENSING APPARATUS

[76] Inventor: Terence William Bolton, Bothwell, Glasgow, G71 8DR, Scotland

[21] Appl. No.: 557,060

[22] PCT Filed: May 5, 1994

[86] PCT No.: PCT/GB94/00959

§ 371 Date: Nov. 13, 1995

§ 102(e) Date: Nov. 13, 1995

[87] PCT Pub. No.: WO94/26421

PCT Pub. Date: Nov. 24, 1994

[30] Foreign Application Priority Data

May 13, 1993 [GB] United Kingdom ..... 9309827

[51] Int. Cl.[6] ..... B05B 7/00

[52] U.S. Cl. ..... 222/630; 222/325; 239/145

[58] Field of Search ..... 222/630, 637, 222/325, 78; 239/326, 145; 401/23, 24, 25; 118/301, 304

[56] References Cited

U.S. PATENT DOCUMENTS

| | | | |
|---|---|---|---|
| 4,446,990 | 5/1984 | Stevenson et al. | 222/630 X |
| 5,156,684 | 10/1992 | Mayer et al. | 118/301 |
| 5,190,220 | 3/1993 | Bolton | 239/326 X |

FOREIGN PATENT DOCUMENTS

| | | | |
|---|---|---|---|
| 2 441 495 | 6/1980 | France . | |
| 61-042350 | 2/1986 | Japan . | |
| 88777 | 11/1920 | Switzerland | 239/326 |
| 237278 | 1/1926 | United Kingdom . | |
| 2 257 058 | 1/1993 | United Kingdom . | |

*Primary Examiner*—Gregory L. Huson
*Attorney, Agent, or Firm*—Kinney & Lange, P.A.

[57] ABSTRACT

An apparatus for dispensing a fine spray of liquid particles is disclosed. The apparatus comprises a hollow tubular housing and a reservoir pen formed with a nib of absorbent material which is retained within and spaced from the inner wall of the housing. The tubular housing includes at one end a nozzle whose interior defines a converging path and at its other end a mouth piece through which air can be caused to flow through the tubular housing and over the pen to the outlet orifice of the nozzle. An abutment is provided within the housing for locating the pen within the housing with its absorbent nib at least partially within the boundary of the outlet orifice of the nozzle.

9 Claims, 2 Drawing Sheets

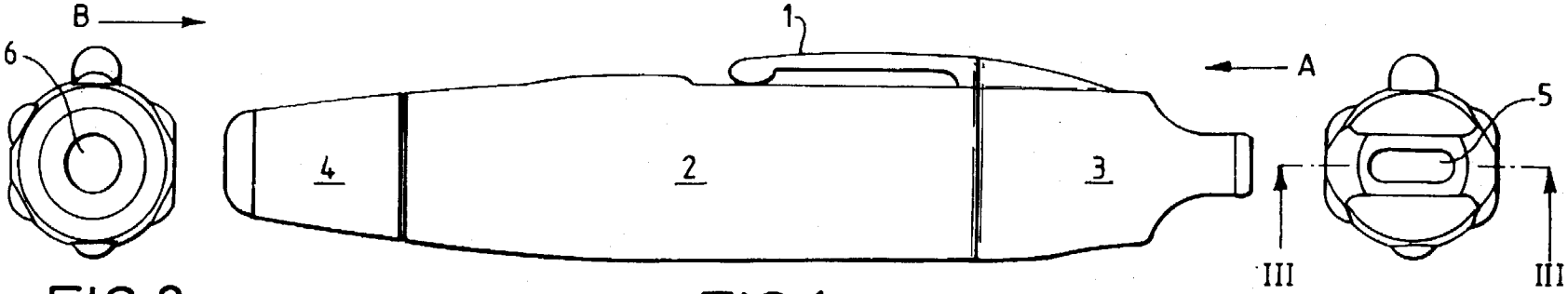
FIG.1.
FIG.2.
FIG.3.
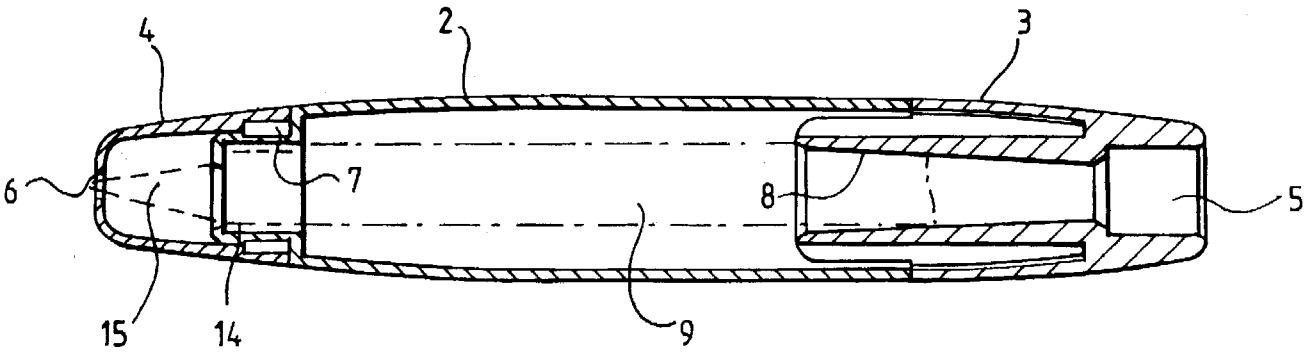
FIG.4.

HAND-HELD LIQUID DISPENSING APPARATUS

BACKGROUND OF THE INVENTION

This invention relates to apparatus for dispensing a fine spray of liquid particles and more especially, but not exclusively to liquid dispensers known as air brushes.

My co-pending British patent applications Nos: 9013745.6 and 9225350.9 disclose apparatus for dispensing a fine spray of liquid particles which comprises a hand or foot operated pump connected to supply air under pressure directly to a nozzle so positioned that air leaving a nozzle is directed onto and over a nib of a pen-like container releasably supported within a holder with the nib of the container in close proximity to the nozzle outlet to cause liquid from the nib to be dispensed as a fine particulate spray in air. Typically the pen-like container is a felt tipped pen.

The present invention sets out to provide a simplified and less costly dispenser which removes the need for a pump but which produces the required fine spray from an absorbent nib of a reservoir pen.

An airbrush for use with a reservoir pen with a nib of absorbent material is disclosed in published British Patent Application 2257058. The reservoir pen disclosed in this application is of special design and includes an end cap formed with a hole to equalise the pressure within the pen reservoir to avoid the presence of a vacuum. Apparatus in accordance with the present invention does not require the presence of such an end cap and can operate effectively using conventional reservoir pens, eg felt-tipped pens. Also, the reservoir pen of GB-A-2257058 is positioned with its nib within the converging portion of the outlet nozzle of the airbrush. Applicant has established that, for best results, it is essential to position the absorbent nib so that it at least partially enters the outlet orifice of the nozzle. One advantage of the present invention is that the dispensing apparatus is constructed to ensure that the reservoir pen is correctly positioned.

JP-A-61042352 discloses an air brush in which high pressure air from a source connected to the air brush by a conduit and controlled by a valve enters a cylinder in which a felt tipped pen is located. An important advantage of the present invention is that the need for an expensive independent source of high pressure air is removed.

SUMMARY OF THE INVENTION

According to the present invention in one aspect there is provided apparatus for dispensing a fine spray of liquid particles which comprises a hollow tubular housing and a reservoir pen formed with a nib of absorbent material retained within and spaced from the inner wall of the housing, the tubular housing including at one end a nozzle whose interior defines a converging path and means for locating the pen within the housing with its absorbent nib at least partially within the boundary of the outlet orifice of the nozzle, the apparatus being characterised in that it has at its end remote from the nozzle a mouth piece through which air can be blown through the tubular housing and over the pen to the outlet orifice of the nozzle.

The nozzle and/or mouthpiece may be releasably secured to the tubular housing and the position of one, or both, may be varied to accommodate pens of different length. Alternatively, the nozzle and/or mouthpiece may be formed integrally with the housing, the pen being either removable from or permanently retained within the housing.

BRIEF DESCRIPTION OF THE DRAWING

The invention will now be described by way of example only with reference to the accompanying diagrammatic drawings in which:

FIG. 1 is a side view of dispensing apparatus in accordance with the invention;

FIGS. 2 and 3 are end views of the apparatus illustrated in FIG. 1 in the directions of arrows "A" and "B" respectively;

FIG. 4 is a side view in section of the apparatus illustrated in FIGS. 1 to 3 taken along line III—III of FIG. 2;

DETAILED DESCRIPTION OF THE PREFERRED EMBODIMENTS

Figure 5:
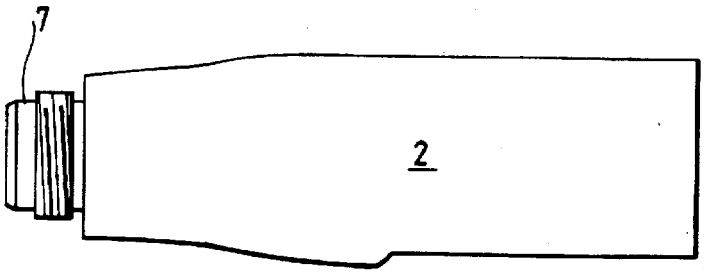
FIG. 5 is a side view of a barrel of the apparatus illustrated in FIGS. 1 and 4.

The apparatus illustrated in FIGS. 1 to 7 of the drawings is in the form of a pen which includes a clip 1. The pen comprises a tubular barrel 2 having at one end a mouth piece 3 and at its other end a converging nozzle 4. The mouth piece is formed with an orifice 5 and the nozzle is formed with an outlet orifice 6. The inner surface of the end of the nozzle 4 and the outer surface of a neck 7 of the barrel 2 are formed with complementary screw threads to enable one to be attached to the other. The mouth piece 3 includes an inwardly extending sleeve 8 which extends into the adjacent end of the barrel 2 to define a push fit connection there between. The sleeve 8 is dimensioned to receive and retain one end of a reservoir pen 9 shown in broken line.

In an alternative arrangement, the nozzle and/or mouthpiece is formed integrally with the barrel.

Figure 6:
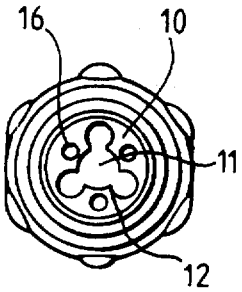
FIGS. 6 and 7 are end views of the barrel illustrated in FIG. 5 taken in the directions "C" and "D" respectively.

As will be seen more clearly from FIG. 6, the end of the barrel 2 which adjoins the nozzle 4 is partially closed by a contoured end wall 10 which includes a central opening 11 defined between inwardly extending lug sections 12 against which abuts the shoulder 14 of the reservoir pen 9. These lugs 12 define abutment surfaces for locating the pen 9 accurately within the barrel 2 with its absorbent nib 15 positioned within the orifice 6 of the nozzle 4. For pens which have longer or shorter nibs, the required adjustment can be effected by movement of the nozzle 4 relative to the barrel 2. The lugs 12 can flex to allow a pen to pass through the opening 11 of the end wall 10 for loading and unloading purposes. Openings defined between the lugs 12 and separate apertures 16 enable air entering the barrel via the mouthpiece to flow into the barrel and over the length of the pen and thence into the converging interior of the nozzle 4. The air accelerates as it passes through the nozzle 4 and over the nib 15 before leaving the nozzle 4 via the orifice 6. As the air accelerates through the orifice 6 liquid particles are removed from the surface of the nib 15 and leave the dispenser as a fine dispersion within the flow of air. Thus, air blown into the dispenser through the mouth piece causes a fine spray of particles of, for example, ink to be deposited onto a sheet, article or the like positioned close to the outlet orifice 6 of the nozzle 4.

Figure 7:
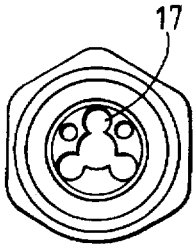

As will be seen from FIG. 7 the end of the barrel 2 adjacent the mouthpiece 5 includes an end wall 17 of similar construction to end wall 10. This end wall defines an abutment surface for the rear end of the pen 9. Thus the end walls 10, 17 of the barrel together define end stops for the pen 9, variations in pen length being accommodated by the position of the mouthpiece 3 on the barrel 2. As mentioned above the position of the nozzle 4 relative to the barrel 2 can be varied simply by turning the nozzle about the cooperating threads to ensure that the nib 15 is always correctly located with respect to the orifice 6. By this means variations in the nib lengths of different felt tipped pens can be accommodated.

A separable cap may be provided which overlies the end of the nozzle 4 to prevent the absorbent nib of the pen drying out.

Figure 8:
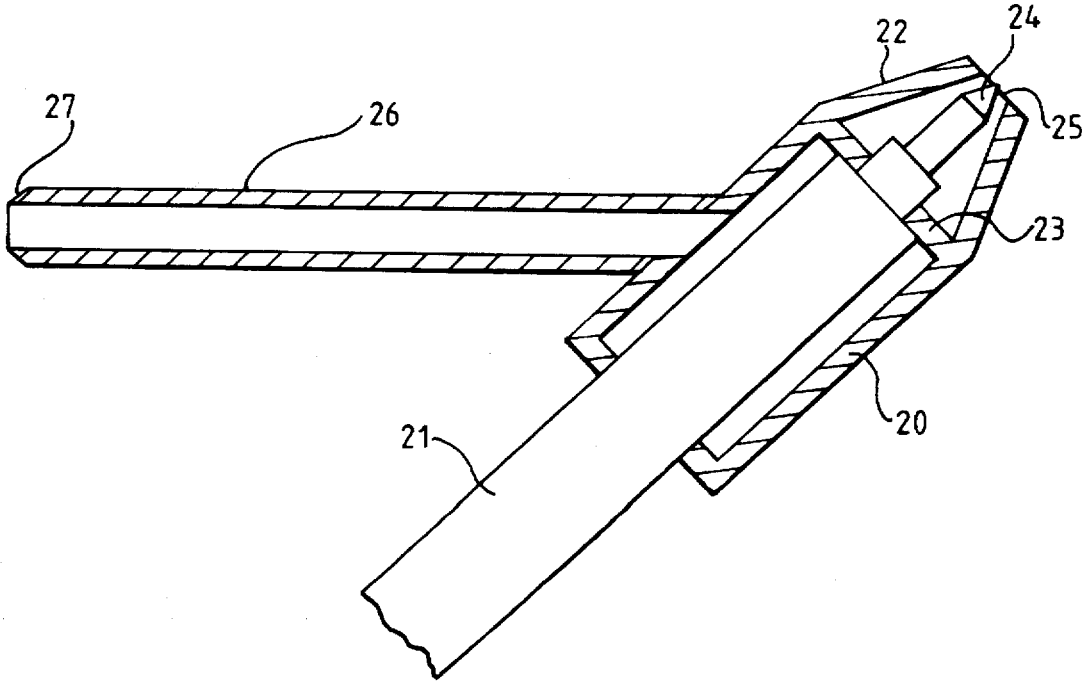
FIG. 8 is a side view in section of alternative apparatus in association with the invention.

Turning now to FIG. 8, the apparatus illustrated includes a barrel 20 formed at one end with an opening through which a reservoir pen 21 protrudes and at its other end with a converging nozzle 22. Inwardly extending legs 23 define an abutment surface against which one end of the pen locates. The lugs 23 are positioned to ensure that the absorbent nib 24 of the pen 21 extends at least partially into the outlet orifice 25 of the nozzle 22. The distance between the orifice 25 and the lugs 23 may be varied to accommodate longer or shorter nibs. Connected to one side of the barrel 20 is a tube 26 formed at its free end with a mouth piece 27. In this embodiment, therefore, air is blown through the mouth piece 27 and tube 26 into the barrel 20 from which it passes over the nib 24 to remove ink particles therefrom which leave as fine spray within the air flow through the nozzle orifice 25.

As before, a cap may be provided for the nozzle to prevent drying out of the absorbent nib of the pen.

The apparatus described can be produced from a variety of materials, one typical material being plastics.

It will be appreciated is merely exemplary of dispensers in accordance with the invention and that modifications can readily be made thereto without departing from the true scope of the invention as set out in the appended claims.

What is claimed is:

1. Apparatus for dispensing a fine spray of liquid particles, the apparatus comprising:

a hollow tubular housing having an inner wall:

a reservoir pen formed with a nib of absorbent material retained within and spaced from the inner wall of the housing;

a nozzle including an outlet orifice at one end of the tubular housing a mouthpiece at the other end of the housing through which air can be blown through the tubular housing and over the pen to the outlet orifice of the nozzle;

and means for locating the pen within the housing with its absorbent nib at least partially within the boundary of the outlet orifice of the nozzle.

2. Apparatus as claimed in claim 1 wherein the nozzle is releasably secured to the tubular housing.

3. Apparatus as claimed in claim 2 wherein the position of the nozzle (4) relative to the housing can be varied.

4. Apparatus as claimed in claim 1 wherein the mouthpiece is releasably secured to the tubular housing.

5. Apparatus as claimed in claim 4 wherein the position of the mouthpiece (3) relative to the housing can be varied.

6. Apparatus as claimed in claim 1 wherein the nozzle is formed integrally with the housing.

7. Apparatus as claimed in claim 1 wherein the mouthpiece is formed integrally with the housing.

8. Apparatus as claimed in claim 2 wherein the mouthpiece is releasably secured to the tubular housing.

9. Apparatus as claimed in claim 6 wherein the mouthpiece is formed integrally with the housing.

* * * * *